United States Patent [19]

Wunderlich

[11] Patent Number: 4,881,871

[45] Date of Patent: Nov. 21, 1989

[54] PERIPHERAL PUMP

[75] Inventor: Erhard Wunderlich, Munich, Fed. Rep. of Germany

[73] Assignee: Speck-Pumpenfabrik, Walter Speck KG, Roth, Fed. Rep. of Germany

[21] Appl. No.: 180,330

[22] Filed: Apr. 11, 1988

[30] Foreign Application Priority Data

Apr. 10, 1987 [DE] Fed. Rep. of Germany ..... 3712165

[51] Int. Cl.[4] ..... F01D 5/14

[52] U.S. Cl. ..... 415/119; 415/98; 415/55.5; 416/203

[58] Field of Search ..... 415/119, 53 T, 213 T, 415/198.2, 194, 98, 195; 416/203, 184, 199

[56] References Cited

U.S. PATENT DOCUMENTS

| | | | |
|---|---|---|---|
| 2,111,441 | 3/1938 | Thrush | 415/98 |
| 2,220,538 | 11/1940 | Neibert | 415/198.2 |
| 2,671,404 | 3/1954 | Krueger | 415/213 T |
| 2,724,338 | 11/1955 | Roth | 415/208 |
| 3,398,866 | 8/1968 | Flame et al. | 416/203 |
| 3,690,621 | 9/1972 | Tanaka et al. | 416/184 |
| 3,849,024 | 11/1974 | Masai et al. | 415/53 T |
| 4,253,800 | 3/1981 | Segawa et al. | 415/119 |
| 4,403,910 | 9/1983 | Watanabe et al. | 415/53 T |

FOREIGN PATENT DOCUMENTS 2046360A 11/1980 United Kingdom .

*Primary Examiner*—Robert E. Garrett
*Assistant Examiner*—John T. Kwon
*Attorney, Agent, or Firm*—Bacon & Thomas

[57] ABSTRACT

The invention concerns a peripheral pump with an impeller, housing and conveyance channel beginning at a suction aperture and passing through at least one flow duct in the housing and impeller blade cells therein to a discharge orifice, the spacing between at least two impeller blades being larger or smaller than the spacing between the other impeller blades.

8 Claims, 1 Drawing Sheet

PERIPHERAL PUMP

BACKGROUND OF THE INVENTION

1. Field of the Invention

The invention concerns a peripheral pump with an impeller comprising a center web continuous as far as the circumference and with one blade ring on each side thereof, further comprising a housing and a conveyance channel starting at a suction aperture and passing through at least one flow duct inside the housing and through impeller blade cells therein to a discharge orifice.

2. Description of Related Art

Contrary to rotary piston or rotary piston pumps, peripheral pumps operate dynamically. A rotating impeller in a pumping chamber transmits kinetic energy from the impeller to the liquid being conveyed, and this energy is converted substantially into pressure energy.

The expression peripheral pump applies to a pump comprising an impeller with bilateral blade rings with short blades separated by a central web and centrally supported in a closed, circular housing. The flow ducts oppositely located to each other on both sides and at the circumference of the impeller consist each of a bilateral side duct part and of the peripheral duct overlapping the outer diameter of the impeller. The flow duct extends almost over the entire area of the impeller and is interrupted between suction and pressure pipe stubs. Ordinarily its cross-section is constant. A narrow slot seals the impeller relative to the housing walls. The suction and pressure pipe stubs are directly connected to the beginning of the flow duct and to its end, whereby the water at the impeller outside enters and is discharged from the flow duct. In the known pumps of this type, all impeller blades are equidistant from each other.

Illustratively such a pump is described in U.S. Pat. No. 2,724,338.

Like all other dynamic machinery, peripheral pumps generate noise in operation. Depending on pump design, such noise is of a characteristic composition.

The main cause of the noise level generated in such pumps are the periodic pressure fluctuations produced by a strongly turbulent, non-stationary flow, in particular when the impeller blades rotate past the housing plate. The pump housing so driven and the connected pipes will then radiate this sound as acoustics into the environment.

Frequently such noises are whistlings, which while not necessary loud, nevertheless often are in a bothersome frequency range, especially when the pump is operating in a low-noise room where the personnel's hearing has adjusted itself to this low level.

Attempts already have been carried out to lower the noise generated by the propellers or impellers of air blowers, gas or steam turbines by irregularly arranging these blades on a shaft or disk. Illustratively reference is made to the British Pat. No. 2,046,360 and the U.S. Pat. Nos. 4,253,800 and 3,398,866. However these known designs concern propellers or impellers mostly with blades slanting relative to a radial chord and mounted either on one side on a disk or projecting clear off a hub. The operation of such known devices and the flow in them does differ significantly however from a peripheral pump's.

SUMMARY OF THE INVENTION

Accordingly it is the object of the invention to create a peripheral pump with a significantly lower noise level, which especially as regards the frequency range affecting human hearing shall generate no operational noise or a much reduced one, and which nevertheless shall be high-performance.

This problem is solved using a peripheral pump of the initially cited kind which is characterized in that the spacing between at least two blades in the two blade rings shall be more or less (i.e., different) than the spacing between the other blades of the blade ring.

Preferably several blades in both blade rings of an impeller shall be at different spacings from each other and will be distributed arbitrarily on the impeller.

Those impellers will be especially advantageous which evince irregular, arbitrary sequences of the blades.

However not all blade spaces need be different. One or several blade spaces can be repeated on an impeller. Further, several adjacent blades, for instance two to four blades, may be spaced the same distance apart and thus form a set of equidistant blades. Such sets may recur more than once on an impeller.

Obviously the blade distribution should be such that dynamic imbalances shall not occur. This can be achieved for instance by using a given distribution of blades on one side also on the other opposite side, though shifted by 180° and in the opposite sequence.

Surprisingly it was found that the peripheral pumps evincing the blade arrangements of the invention generate a substantially lower noise level, especially in the disagreeable higher frequency ranges sensed by the human ear. Significantly, they emit no bothersome noise, or only little, in the range from 2 to 8 kHz.

Heretofore it had been felt that equidistant blades and hence uniform impellers were necessary to produce a uniform flow and optimal conveyance. Surprisingly however it was found that the conveyance or output does not suffer from the irregular blade arrangement of the pumps of the invention.

Further features and advantages of the invention are discussed below in the description of an illustrative embodiment and shown in the drawings.

DESCRIPTION OF THE PREFERRED EMBODIMENT

Figure 1:
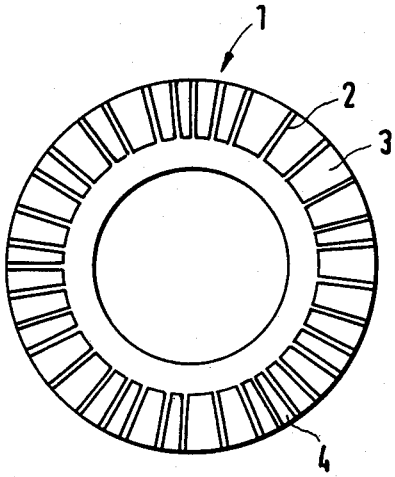
FIG. 1 is a topview of an impeller of the invention of a peripheral pump.
Figure 2:
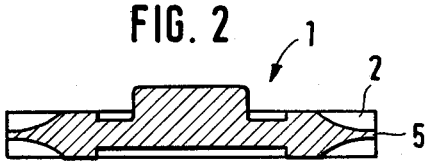
FIG. 2 is a cross-section of an impeller of FIG. 1.

The impeller of a peripheral pump shown in FIG. 1 is operated together with the conventional parts of such a pump. As shown in FIG. 1, the impeller blades 2 are spaced apart varyingly from each other. The reference numeral 3 denotes a comparatively large separation, while the reference 4 denotes a comparatively small one.

Figure 3:
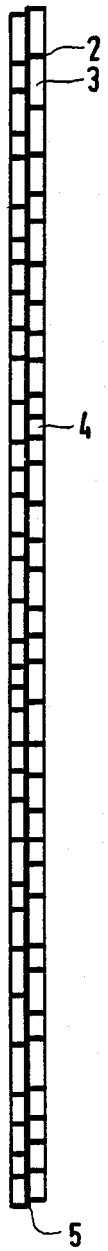
FIG. 3 is a developed projection of an impeller of FIG. 1.

The developed projection of FIG. 1 shown in FIG. 3 shows the varying spacings 3 and 4 of the blades 2 even more clearly. The other impeller half on the other side of the central web 5 in this case evinces the same blade distribution but shifted by 180° relative to the first one and in the inverse order relative to the sequence of the opposite blade ring. In this manner dynamic imbalance of the impeller can be avoided.

As a rule the angular deviation of the blades from a uniform, symmetric will be between +100% and −80%, especially +50% and −50%. All intermediate values are included each time.

If a conventional impeller of 35 blades were used, the blades would be angularly separated by 10°.

In the invention, the impeller is so designed that the angular deviation is a maximum of ±50% from the uniform 10° division. Accordingly the largest angle subtended by two adjacent blades in this instance shall be 15° and the least shall be 5°.

Blade separations of arbitrary intermediate values are present in arbitrary sequence.

An example of an advantageous distribution of 35 blades on each of the two blade rings of a peripheral impeller over 360° is as follows:

| | | | | | | | | |
|---|---|---|---|---|---|---|---|---|
| Blade # | 1 | 2 | 3 | 4 | 5 | 6 | 7 | 8 |
| Angle (°) | 7 | 17 | 32 | 39 | 52 | 60 | 75 | 84 |
| Blade # | 9 | 10 | 11 | 12 | 13 | 14 | 15 | 16 |
| Angle (°) | 91 | 100 | 109 | 124 | 139 | 153 | 165 | 173 |
| Blade # | 17 | 18 | 19 | 20 | 21 | 22 | 23 | 24 |
| Angle (°) | 186 | 198 | 207 | 215 | 225 | 232 | 238 | 246 |
| Blade # | 25 | 26 | 27 | 28 | 29 | 30 | 31 | 32 |
| Angle (°) | 258 | 271 | 278 | 290 | 298 | 306 | 318 | 331 |
| Blade # | 33 | 34 | 35 | | | | | |
| Angle (°) | 340 | 351 | 360, | | | | | |

the two blade rings being mutually offset by 180° and the blade sequence of one blade ring being opposite to the sequence of the other blade ring.

It will be appreciated that varations of the above preferred embodiment will occur to those skilled in the art, and that the invention should consequently be limited solely by the appended claims.

I claim:

1. A peripheral pump with an impeller ring comprising two blade rings on each side of a central web, and further comprising a housing and a conveyance channel which extends from a suction aperture and passes through at least one flow duct and impeller blades in the housing to a discharge orifice, wherein the spacing between at least one adjacent pair of blades in each impeller ring is different than the spacing between at least one other pair of blades on the same ring, said impeller blades extending substantially radially in respect to the respective circumference of said rings.

2. A pump as claimed in claim 1, characterized in that a plurality of said blades in both impeller blade rings are spaced varyingly apart and that these varyingly separated blades are distributed arbitrarily in the blade rings.

3. A pump as claimed in claim 1 or 2 wherein all of the impeller blades are irregularly spaced in arbitrary sequence.

4. A pump as claimed in claim 1, wherein at least one blade spacing recurs on the impeller.

5. A pump as claimed in claim 1, wherein one or more sets of adjacent blades will evince the same blade separation in each blade ring.

6. A pump as claimed in claim 1, wherein the angular deviation from a uniform angular division between adjacent blades is at most ±50%.

7. A pump as claimed in claim 6, wherein, for an impeller with 35 blades, the largest angle subtended by two adjacent blades shall be 15° and the smallest angle shall be 5° for each blade ring.

8. A pump as claimed in claim 7, wherein the 35 blades of each blade ring are distributed as follows over 360°:

| | | | | | | | | |
|---|---|---|---|---|---|---|---|---|
| Blade # | 1 | 2 | 3 | 4 | 5 | 6 | 7 | 8 |
| Angle (°) | 7 | 17 | 32 | 39 | 52 | 60 | 75 | 84 |
| Blade # | 9 | 10 | 11 | 12 | 13 | 14 | 15 | 16 |
| Angle (°) | 91 | 100 | 109 | 124 | 139 | 153 | 165 | 173 |
| Blade # | 17 | 18 | 19 | 20 | 21 | 22 | 23 | 24 |
| Angle (°) | 186 | 198 | 207 | 215 | 225 | 232 | 238 | 246 |
| Blade # | 25 | 26 | 27 | 28 | 29 | 30 | 31 | 32 |
| Angle (°) | 258 | 271 | 278 | 290 | 298 | 306 | 318 | 331 |
| Blade # | 33 | 34 | 35 | | | | | |
| Angle (°) | 340 | 351 | 360, | | | | | |

and wherein the two blade rings are mutually offset by 180° and the blade sequence of one blade ring is opposite the blade sequence of the other blade ring.

* * * * *